US010006266B2

(12) United States Patent
Sundararajan et al.

(10) Patent No.: US 10,006,266 B2
(45) **Date of Patent: *Jun. 26, 2018**

(54) LIGHTWEIGHT AND COMPACT SUBSEA INTERVENTION PACKAGE AND METHOD

(71) Applicant: Worldwide Oilfield Machine, Inc., Houston, TX (US)

(72) Inventors: Alagarsamy Sundararajan, Katy, TX (US); Tom McCreadie, Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/265,435

(22) Filed: Apr. 30, 2014

(65) Prior Publication Data

US 2014/0231090 A1 Aug. 21, 2014

(51) Int. Cl.

| | |
|---|---|
| ***E21B 33/038*** | (2006.01) |
| ***E21B 33/064*** | (2006.01) |
| ***E21B 33/076*** | (2006.01) |
| ***E21B 17/02*** | (2006.01) |

(52) U.S. Cl.

CPC ..... *E21B 33/038* (2013.01); *E21B 17/02* (2013.01); *E21B 33/064* (2013.01); *E21B 33/076* (2013.01)

(58) Field of Classification Search

CPC ..... E21B 17/02
USPC ..... 166/348, 338, 368, 363, 344, 86.3; 251/1.1, 1.3

See application file for complete search history.

(56) References Cited

U.S. PATENT DOCUMENTS

| | | | |
|---|---|---|---|
| 2,693,373 | A | 11/1954 | Tremolada |
| 2,701,146 | A | 2/1955 | Warren |
| 2,788,073 | A | 4/1957 | Brown |
| 2,991,042 | A | 7/1961 | Natho |
| 3,378,224 | A | 4/1968 | Boyle |
| 3,379,405 | A | 4/1968 | Natho |
| 3,466,001 | A | 9/1969 | Nelson |

(Continued)

FOREIGN PATENT DOCUMENTS

WO WO 2014/039622 3/2014

OTHER PUBLICATIONS

Schlegelmitch,The Design of a Coiled Tubing Cutter for Use in Subsea Oil Drilling Applications, Masters Thesis, Massachusetts Institute of Technology, 1999.

(Continued)

*Primary Examiner* — Matthew R Buck
*Assistant Examiner* — Aaron L Lembo
(74) *Attorney, Agent, or Firm* — Kenneth L. Nash; Thomas D. Nash

(57) ABSTRACT

The present invention discloses apparatus and methods for a lightweight subsea intervention package that may be installed using vessels with a smaller lifting capacity than semi-submersible platforms so that the subsea intervention package can be transported, installed, and removed from a subsea well in less time and with less cost. In one embodiment, the present invention comprises a lower riser package for controlling the subsea well which utilizes two hydraulically activated gate valves. An emergency disconnect package is secured to the lower riser package utilizing a disconnect mechanism. The emergency disconnect package is operable to seal the bottom of a riser if the disconnect mechanism is activated to thereby minimize environmental leakage of fluid from the riser.

29 Claims, 7 Drawing Sheets

(56) References Cited

U.S. PATENT DOCUMENTS

| | | | |
|---|---|---|---|
| 3,572,032 | A | 3/1971 | Terry |
| 3,765,642 | A | 10/1973 | Nelson |
| 3,842,854 | A | 10/1974 | Wicke |
| 3,889,922 | A | 6/1975 | Peters |
| 3,913,883 | A | 10/1975 | Irwin |
| 3,964,305 | A | 6/1976 | Wray et al. |
| 3,981,188 | A | 9/1976 | Barrington et al. |
| RE29,562 | E | 3/1978 | Wray et al. |
| 4,081,027 | A | 3/1978 | Nguyen et al. |
| 4,212,355 | A | 7/1980 | Reardon |
| 4,213,480 | A | 7/1980 | Orum et al. |
| 4,215,749 | A | 8/1980 | Dare et al. |
| 4,230,299 | A | 10/1980 | Pierce, Jr. |
| 4,240,455 | A | 12/1980 | McGee |
| 4,253,525 | A | 3/1981 | Young |
| 4,368,871 | A | 1/1983 | Young |
| 4,414,995 | A | 11/1983 | Spencer |
| 4,423,748 | A | 1/1984 | Ellett |
| 4,436,279 | A | 3/1984 | Bonds et al. |
| 4,437,521 | A | 3/1984 | Richardson et al. |
| 4,445,424 | A | 5/1984 | Foster et al. |
| 4,590,823 | A | 5/1986 | Nevesm et al. |
| 4,619,434 | A | 10/1986 | Snyder et al. |
| 4,649,704 | A | 3/1987 | Marsh |
| 4,650,151 | A | 3/1987 | McIntyre |
| 4,658,904 | A | 4/1987 | Doremus et al. |
| 4,668,126 | A | 5/1987 | Burton |
| 4,671,312 | A | 6/1987 | Bruton |
| 4,744,386 | A | 5/1988 | Frazer |
| 4,753,292 | A | 6/1988 | Ringgenberg et al. |
| 4,790,378 | A | 12/1988 | Montgomery et al. |
| 4,809,733 | A | 3/1989 | Hawkins |
| 4,827,963 | A | 5/1989 | Baker et al. |
| 4,830,107 | A | 5/1989 | Rumbaugh |
| 4,836,243 | A | 6/1989 | Ferrell |
| 4,848,463 | A | 7/1989 | Ringgenberg et al. |
| 4,878,651 | A | 11/1989 | Meyer, Jr. |
| 4,886,115 | A | 12/1989 | Leggett et al. |
| 4,921,207 | A | 5/1990 | Baker |
| 4,967,785 | A | 11/1990 | Young |
| 4,997,162 | A | 3/1991 | Baker et al. |
| 5,269,340 | A | 12/1993 | Drzewiecki |
| 5,501,424 | A | 3/1996 | Williams et al. |
| 5,803,431 | A | 9/1998 | Hoang et al. |
| 5,845,708 | A | 12/1998 | Burge et al. |
| 5,894,771 | A | 4/1999 | Braun et al. |
| 5,938,175 | A | 8/1999 | Young et al. |
| 6,041,804 | A | 3/2000 | Chatufale |
| 6,053,252 | A * | 4/2000 | Edwards ..... 166/348 |
| 6,109,353 | A * | 8/2000 | Edwards ..... E21B 17/01 166/344 |
| 6,209,650 | B1 | 4/2001 | Ingebrigtsen et al. |
| 6,223,825 | B1 | 5/2001 | Ingebrigtsen et al. |
| 6,260,822 | B1 | 7/2001 | Puranik |
| 6,457,370 | B1 | 10/2002 | Okano |
| 6,684,897 | B2 | 2/2004 | Sundararajan |
| 6,966,537 | B2 | 11/2005 | Sundararajan |
| 7,013,970 | B2 | 3/2006 | Collie et al. |
| 7,849,926 | B2 * | 12/2010 | Inderberg ..... E21B 17/06 137/68.14 |

OTHER PUBLICATIONS

Ali Chareuf Aphgoul, et al., "Coiled Tubing: The Next Generation," Oilfield Review, Spring 2004.

Excerpts from Coiled Tubing Handbook, 3rd Edition, 1998.

"System Requirements Well Intervention Equipment", NORSOK Standard D-002, Rev. 1, Oct. 2000.

Shear Ram Test, Excerpts of American Petroleum Institute(API) Specification 16A, Section 4.7.2.4, 1997.

Joint Claim ConstructionPrehearing Statement, *Worldwide Oilfield machine, Inc.* v. *Ameriforge Group, Inc.*, Civil Action No. 4:13-cv-3123 (S.D. Tex.)(filed Aug. 15, 2014).

Glen Stevick, Declaration in Support of Inter Partes Review(2014).

Excerpts from McGraw-Hill Dictionary of mechanical and Design Engineering (1984).

MIT Libraries Catalog Page for Schlegelmitch,The Design of a Coiled Tubing Cutter for Use in Subsea Oil Drilling Applications, Massachusetts Institute of Technology, 1999.

Patent Owner Preliminary Response concerning U.S. Pat. No. 6,601,650, Inter Partes Review Case No. 2015-00233, Paper No. 12, 2015.

* cited by examiner

LIGHTWEIGHT AND COMPACT SUBSEA INTERVENTION PACKAGE AND METHOD

This application is a continuation application of U.S. patent application Ser. No. 12/542,938, filed Aug. 18, 2009, which is incorporated herein in its entirety, and is a continuation application of U.S. patent application Ser. No. 10/532,358, filed Apr. 20, 2005, now U.S. Pat. No. 7,578, 349, which is incorporated herein in its entirety, and U.S. patent application Ser. No. 10/532,358 claims benefit of U.S. Provisional Application No. 60/478,988 filed Jun. 17, 2003, which is incorporated herein in its entirety, and is a continuation-in-part of U.S. patent application Ser. No. 09/992, 220 filed Nov. 6, 2001, now U.S. Pat. No. 6,601,650 B2, which is incorporated herein in its entirety, and is a continuation-in-part of U.S. patent application Ser. No. 09/925, 676, filed Aug. 9, 2001, now U.S. Pat. No. 6,575,426 B2, which is incorporated herein in its entirety, and is a continuation in part application of U.S. patent application Ser. No. 09/802,209 filed Mar. 8, 2001, now U.S. Pat. No. 6,609,533 B2, which is incorporated herein in its entirety, and is a continuation in part application of U.S. patent application Ser. No. 10/459,243, filed Jun. 11, 2003, now U.S. Pat. No. 7,040,408, which is incorporated herein in its entirety, and claims benefit of U.S.provisional application 60/318,371 filed Sep. 10, 2001, which is incorporated herein in its entirety.

BACKGROUND OF THE INVENTION

1. Field of the Invention

The present invention relates generally to subsea intervention packages and, more particularly, to a lightweight and compact subsea intervention package.

2. Description of the Background

Often subsea wells do not perform at/to the same levels of performance as platform wells mainly due to the high costs of servicing subsea wells, which may be referred to herein as subsea well interventions. The subsea well Christmas tree, also referred to herein as a production tree, may typically be either a vertical production tree or a horizontal production tree wherein the horizontal subsea production tree may have a larger internal diameter. FIG. 4A, FIG. 4B, FIG. 5A and FIG. 5B show representative examples of vertical and horizontal subsea production or Christmas trees. A subsea intervention package preferably provides a means for connecting the various types of subsea trees to perform workover operations while still maintaining control over the subsea well.

If necessary, a subsea intervention package should provide means to isolate and seal the well in emergency situations, e.g., if a dynamically positioned drilling ship or unanchored semi-submersible platform loses the ability to maintain its position above the subsea well. Emergency disconnect systems should preferably be able to reliably sever any tubing and/or wireline that extends through the Christmas tree and then seal and isolate the well in case it is necessary to disconnect from the well due to an emergency. Prior art systems may be slow to operate to perform these functions and may sometimes allow significant amounts of fluid leakage before isolation is accomplished. It would be more desirable to provide a more effective and environmentally-friendly subsea intervention package.

The maximum internal diameter is a critical dimension for an intervention package because an internal tree plug must normally be retrievable through this dimension. A small increase in the size of the tree plug often results in a significant increase in the size of the intervention package. Horizontal subsea trees tend to have a larger internal diameter tree plug. Crown or tree plugs in horizontal production trees tend to be a maximum of about six and three-quarters inch in diameter and may be considerably less. Due to various construction that may exist around the subsea well it is desirable that the subsea intervention package be compact and not include elements that extend outwardly from the design dimensions of the subsea intervention package. The most commonly utilized subsea intervention package for well completions comprises a high pressure riser system in combination with a subsea drilling BOP and a marine riser for access to the well. This system is very heavy and bulky. A subsea drilling BOP intervention system may weigh in the range of 500,000 to 1,000,000 tons. The system may often require the capabilities of a semi-submersible platform, which may be of the type requiring anchors, to lower and raise the intervention package. Accordingly, the time to move the platform to location and set the anchors is rather long. The bulky system must also be lowered, installed, and then removed. The overall cost of the intervention operation utilizing a subsea drilling BOP intervention system is quite high but the system provides the means for doing any type of desired work.

Other attempts to produce lightweight systems have limitations that make them unsuitable for some types of intervention work.

Consequently, those skilled in the art will appreciate the present invention that addresses the above problems with a lightweight and compact subsea intervention package that can be transported, installed, and then removed from a subsea well more quickly to provide a wide range of operations, and which is operable to cut and seal any working strings therein in a fail-safe mode.

SUMMARY OF THE INVENTION

An objective of the present invention is to provide an improved light weight intervention package.

Another objective is to provide a system operable to control a subsea well in a fail safe mode wherein hydraulic power to the cutting unit has been lost.

Another objective of the present invention is the capability to operate with Horizontal and Vertical Christmas tree wellheads.

Another objective of the present invention is to provide a light weight intervention package for use with 7⅜ inch bore and operable for severing 2⅞ inch coiled tubing if necessary and/or severing production tubing with 0.204 wall thickness and/or reliably and repeatably cutting tubulars of at least 2¾" or more, if desired, without the need for maintenance.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages. Moreover, the scope of this patent is not intended to be limited to its literal terms but instead embraces all equivalents to the claims described.

Accordingly, the present invention comprises a lightweight subsea intervention package for use in servicing a subsea well. The subsea well may comprise at least one of a vertical Christmas tree or a horizontal Christmas tree. The subsea intervention package may preferably be operable for containing the subsea well even while using at least one of tubing, pipe, rods, coiled tubing, or wireline, which may need to be cut in an emergency, during the servicing of the subsea wells. The subsea intervention package may comprise one or more elements such as, for example only, a lower package attachable to the subsea well regardless of whether the subsea well comprises the vertical Christmas tree or the horizontal Christmas tree. The lower package may further comprise at least two hydraulically actuated valves wherein preferably neither of which are B.O.P.'s. At least one of the at least two hydraulically actuated valves may preferably be operable cutting the tubing, coiled tubing, wireline, and/or other members, and then closing to form a seal for sealing the subsea well. In one possible embodiment, the lower package may define a bore through the two hydraulically actuated valves which is greater than seven inches. In a preferred embodiment, the lightweight subsea intervention package may be light enough and define a footprint small enough such that the lightweight subsea intervention package can be installed on the subsea well utilizing a vessel with a handling capacity less than that of a semi-submersible platform.

In one embodiment, the lightweight subsea intervention package weighs between ten and forty tons. The lightweight subsea intervention package may further comprise an emergency disconnect mechanism comprising a first portion and a second portion. The first portion of the emergency disconnect mechanism may be secured to the lower package. The first portion and the second portion of the emergency disconnect mechanism may be selectively separable. An emergency disconnect package may be provided which is mountable to the second portion of the emergency disconnect mechanism. The emergency disconnect mechanism may, if desired, further comprise at least one hydraulically actuated valve defining a bore through the at least one hydraulically actuated valve which is greater than seven inches.

The two hydraulically actuated valves of the lower riser package and the at least one hydraulically actuated valve of the emergency disconnect package may also define a bore therethrough which is greater than seven and one-eighth inches or may define a bore greater than six and one-eighth inches. Generally, the larger the bore, the better.

The emergency disconnect package may be securable to a riser. The emergency disconnect package may preferably operable to seal a lower end of the riser if the emergency disconnect mechanism is activated to separate the emergency disconnect package from the lower package.

In one embodiment, a preferred hydraulically actuated valve comprises a fail-safe actuator mounted on one side of a valve body and a manual override actuator mounted on an opposite side of the valve body. In a presently preferred embodiment, a hydraulically actuated valve comprises a gate valve which comprises a cutter and seal assembly.

The present invention also comprises a method for making a lightweight subsea intervention package for use in servicing a subsea well. The method may comprise one or more steps such as, for instance, providing a lower package attachable to the subsea well regardless of whether the subsea well comprises the vertical Christmas tree or the horizontal Christmas tree. Another step may comprise providing that the lower package comprises at least one hydraulically actuated valve operable for both cutting the tubing, coiled tubing, elongate member, and/or wireline which extends through the valve and for then closing to form a seal for sealing the subsea well. Additional steps may comprise providing that the lower package defines a bore through the hydraulically actuated valves which is greater than a production tree cap. Other steps may comprise providing that the lightweight subsea intervention package is light enough and defines a footprint small enough such that the lightweight subsea intervention package can be installed on the subsea well utilizing a vessel with a handling capacity less than that of a semi-submersible platform.

In one embodiment, the method may further comprise providing that the lower package weighs between ten and forty tons and/or providing that the emergency disconnect package weighs between five and twenty tons.

The method may further comprise providing an emergency disconnect mechanism comprising a first portion and a second portion such that the first portion of the emergency disconnect mechanism is attachable to the lower package and that the first portion and the second portion of the emergency disconnect mechanism are selectively separable. Additional steps may comprise providing that the emergency disconnect package is mountable to the second portion of the emergency disconnect mechanism and providing at least one hydraulically actuated valve for the emergency disconnect mechanism defines a bore through the at least one hydraulically actuated valve which is greater than seven inches.

In another embodiment, the method may comprise providing at least two hydraulically actuated valves for the lower package and/or providing that the emergency disconnect package is securable to a riser. Additional steps may comprise providing that the emergency disconnect package is operable to seal a lower end of the riser if the emergency disconnect mechanism is activated to separate the emergency disconnect package from the lower package. As well for use with a subsea lubricator, the method may further comprise providing that the emergency disconnect package is replaceable with a subsea lubricator to permit subsea wireline operations without use of a riser.

In one embodiment for use with a riser, the method may further comprise providing an integral swivel and flow head for the riser to permit a vessel supporting the riser to weather around the riser, The integral swivel and flowhead also provides a surprisingly improved handling capability of the riser system by the support vessel, rig, or other means utilized to control the subsea well intervention.

The method may further comprise providing that at least one hydraulically actuated valve comprises a fail-safe actuator which is mounted on one side of a valve body and a manual override actuator mounted on an opposite side of the valve body. This arrangement reduces weight and prevents members from extending outside the designated dimensions while providing a large borehole. Additionally, the method may further comprise mounting an independent supply of hydraulic fluid on the subsea intervention package and providing that at least one hydraulically actuated valve comprises an actuator mounted on one side of the at least one hydraulically actuated valve operable to utilize the independent supply of hydraulic fluid.

BRIEF DESCRIPTION OF THE DRAWINGS

For a further understanding of the nature and objects of the present invention, reference should be had to the following detailed description, taken in conjunction with the accompanying drawings, in which like elements may be given the same or analogous reference numbers and wherein.

Figure 1:
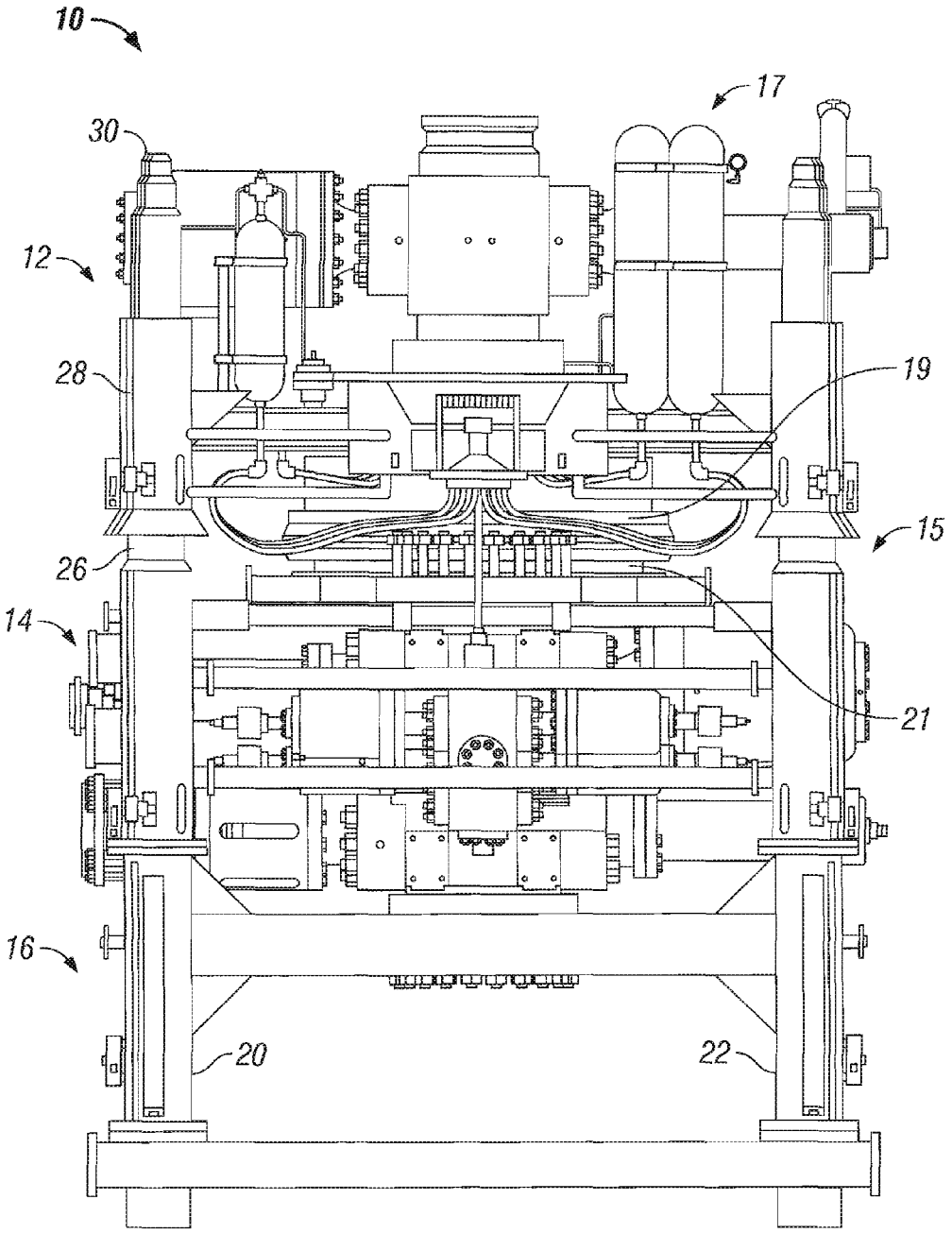
FIG. 1 is an elevational view of a subsea intervention package in accord with one possible embodiment of the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

BRIEF DESCRIPTION OF THE PREFERRED EMBODIMENTS

Referring now to the drawings, and more particularly to the figure, there is shown one embodiment of a lightweight, compact, subsea intervention package 10, in accord with the present invention. Due to the physical space limitations surrounding the wellbore, such as equipment already in place around the subsea wellbore, it is desirable that subsea intervention package 10 be as compact as possible with little or no extensions outside of the frame. The absence of components jutting substantially outside the boundaries of the subsea intervention package also makes subsea intervention package 10 much easier to handle and deploy.

In one preferred embodiment of the present invention, subsea intervention package 10 may be utilized in either a riser mode or a subsea wireline mode and/or a subsea coiled tubing mode, as discussed in more detail hereinafter. Subsea intervention package 10 is modular to permit changing from one mode of operation to another with minimum time and effort. In one preferred embodiment, subsea intervention package 10 provides a controllable conduit 80 (see FIG. 2) therethrough which has an internal minimum inner diameter of 7⅜ inches while still providing a relatively compact subsea intervention package. As discussed hereinafter, subsea intervention package 10 is operable to cut coiled tubing at least up to 2⅞ inches with wireline disposed therein.

Subsea intervention package 10 preferably comprises an emergency disconnect package, shown generally at 12 and a lower riser package, shown generally at 14. The emergency disconnect package and lower riser package may each comprise one or more gate valves of various types, which are shown more clearly in FIGS. 1A and 1B. An emergency disconnect mechanism 15 is utilized to separate emergency disconnect package 12 from lower riser package 14 if this should become necessary during operation. In one preferred embodiment, emergency disconnect mechanism 15 is operated with collets or other releasable securing means, e.g., dogs, latches, remote controlled pins, and the like, which can selectively either securely hold when large forces are applied thereto or be quickly released to allow complete separation, if necessary. Disconnect mechanism 15 comprises an upper portion 19 and a lower portion 21 which separate if disconnect mechanism 15 is activated. Emergency disconnect package 12 is secured to upper portion 19, and lower riser package 14 is secured to lower portion 21.

Intervention package 10 is preferably mountable to a standardized wellhead adaptor frame such as adaptor frame 16. Adaptor frame 16 may be provided at the subsea wellhead and/or be provided to establish an interface with the subsea well. The distance from post 20 to post 22 may be about fourteen feet or another standard value. It will be noted that the present invention is virtually contained within these dimensions with no components jutting significantly outwardly from these dimensions. The frame may be comprised of posts, such as frame post 30 and/or frame post 26, which are insertable into frame sockets such as frame socket 28. Subsea intervention package 10 preferably takes advantage of any existing standardized connection means for quick installation. In operation, an ROV (remotely operated vehicle) may guide the frame sockets into alignment with frame posts and/or may help with the subsea intervention package deployment in other suitable ways.

Figure 1A:
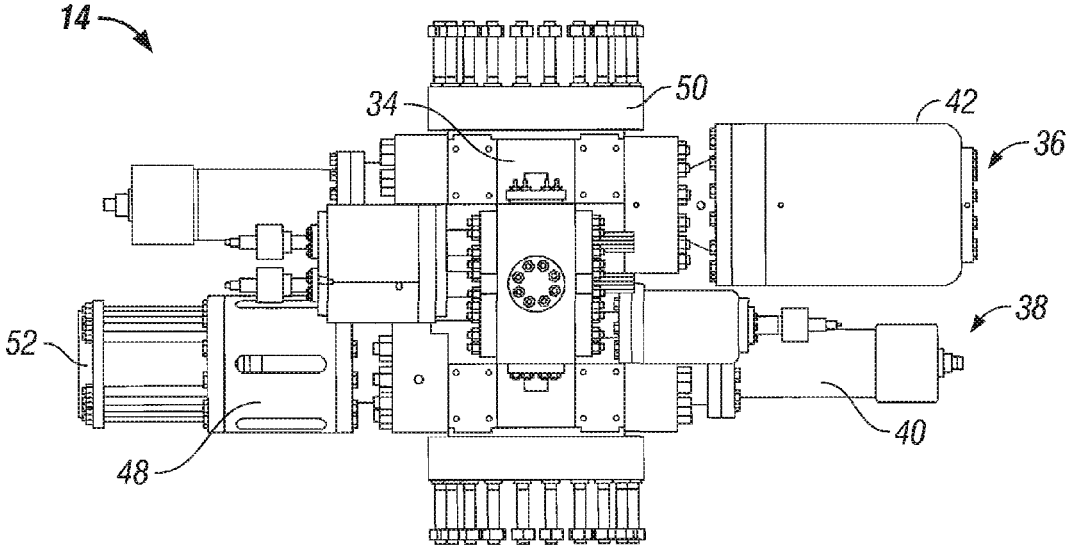
FIG. 1A is an elevational view of components of a preferred lower riser package for the subsea intervention package of FIG. 1 in accord with one possible embodiment of the present invention.

Referring now to FIG. 1A, various types of hydraulic gate valve actuators may be utilized within lower riser package 14, such as fail-safe gate valve actuator 36 and hydraulic actuator 38 for operating corresponding slidable gates to seal off the wellbore. An exemplary embodiment of a fail-safe gate valve actuator is disclosed in the afore-referenced patents which are incorporated herein by reference. In the present invention, gate valves are utilized to seal but also be required to cut tubing and/or wireline as necessary. Subsea intervention package 10 shown in FIG. 1 is of a type that may be utilized in very deep water including water depths up to and beyond 5000 feet or 10,000 feet or more.

Upper valve 36 and lower valve 38 may preferably be mounted within one-piece or monolithic block 34. This monolithic construction is preferred in accord with the present invention. Each gate valve preferably comprises an actuator and a manual override actuator, e.g., manual override actuator 40. The manual override actuator(s) may be operated by a ROV. Manual override 40 is located on opposite side of mono block 34 from the corresponding hydraulic actuator 48. This symmetrical construction significantly reduces the overall size and weight of the gate valves. In a preferred embodiment, the gate valve operator can be removed for service without removing the valve bonnet. A valve position indicator is provided that is viewable from all sides by an ROV. Various types of indicators may be utilized to indicate the position of the manual override operator and/or the position of the actuator as discussed in the aforementioned patents. Upper gate valve 36 and lower gate valve 38 preferably each comprise a specially profiled slidable gate operating with special seal assemblies which provide the capability of cutting wireline such as braided cable or slick line as described in more detail in the aforementioned patents. Upper and lower gate valves 36 and 38 may also be utilized to cut production tubing and coiled tubing as discussed in more detail in the aforementioned patents. Upper and lower gate valves 36 and 38 are each individually moveable between an open position and a closed position whereby fluid flow through conduit or wellbore 80 (See FIG. 2) may be controlled.

As discussed earlier, upper gate valve 36 of lower riser package 14 connects to emergency disconnect mechanism 15. If emergency disconnect mechanism 15 is activated, then lower riser package 14 remains in position secured to the subsea wellhead and seals off the subsea well with gate valves 36 and 38 providing redundant sealing capability. Upper gate valve 36 comprises an actuator spring within the housing of fail-safe actuator 42 which is capable of cutting wireline and/or tubing and operable for closing after cutting within 18 seconds. If hydraulic power is lost, then upper gate valve 36 is automatically activated because actuator 42 is preferably a fail-safe actuator that moves to a pre-selected position, e.g., the closed position, if a hydraulic power failure occurs. The actuator spring within failsafe actuator 42 is preferably isolated internally from hydraulic fluid to prevent exposure and thereby provide for extended life operation, reduced maintenance, and greater assurance of full spring design strength. The actuator spring may preferably be provided within a pre-tensioned spring chamber. Because the spring chamber prevents the spring from extending past a predetermined length, and because the spring chamber is removable, the high tension spring can be safely removed and replaced even in the field where removal of such high energy springs is otherwise a potential safety hazard. Monolithic block 34 is substantially symmetrical so that failsafe actuator 42 and the corresponding manual override actuator may be switched in position and to provide more economy of space and weight within subsea intervention package 10.

Lower actuator 38 may be operated utilizing an independent subsea accumulator bank, e.g., bank 17 (see FIG. 1) or hydraulic storage bank. This ensures a rapid response time in case an emergency shut down signal is given to close off wellbore 80 (See FIG. 2) thereby preventing or minimizing fluid leakage. Lower riser package 14 has a small profile as explained above making it easy to handle and launch. The small weight, generally in the range of about fifteen to thirty thousand tons, permits lower riser package 14 to be handled and/or deployed by relatively more mobile, smaller, less expensive vessels, to thereby significantly reduce time, equipment rental costs, and other costs of the subsea interference operation.

Figure 1B:
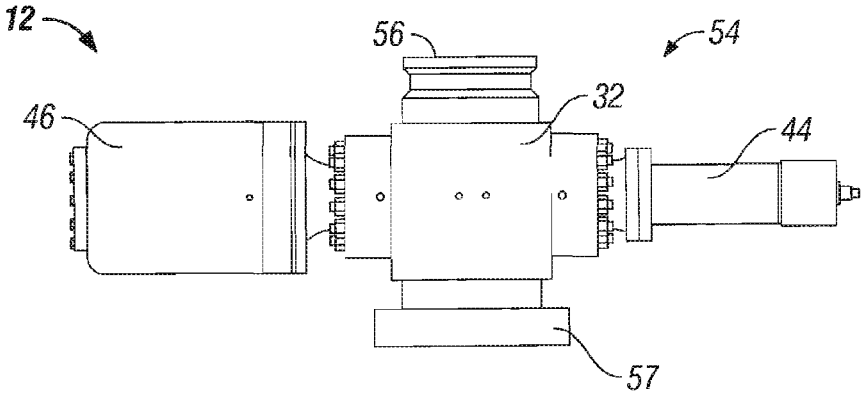
FIG. 1B is an elevational view of components of an emergency disconnect package for use subsea intervention package of FIG. 1 in accord with one possible embodiment of the present invention.

Referring to FIG. 1B, emergency disconnect package 12 comprises gate valve 54 with hydraulic failsafe actuator 46 and manual override actuator 44 mounted opposite thereto. Block 32 is symmetrical so that fail safe actuator 46 and manual override actuator 44 could be positioned on either side of preferably monolithic block 32. Gate valve 54 preferably utilizes a pilot operated quick dump valve whereby loss of hydraulic pressure causes gate valve 54 to close. When gate valve 54 closes, and assuming intervention package 10 is operating in the riser mode, then gate valve 54 closes the bottom of the riser thereby preventing spillage from the disconnected riser as occurs in prior art systems. Gate valve 54 is operable for cutting wireline and/or tubing. Connector 56 may connect to a riser as discussed hereinafter and preferably provides for a large 7⅜ inch bore in a small subsea interference package. Lower connector 57 connects to emergency disconnect mechanism 15, which may be automatically disconnected from lower riser package 14 in case of an emergency.

Emergency disconnect package 10 may typically weigh less than about twenty tons and emergency disconnect package 12 may weigh less than about ten tons. The light weight and streamlined construction permit the system to be handled by smaller vessels thereby reducing the time and cost of interventions.

Figure 2:
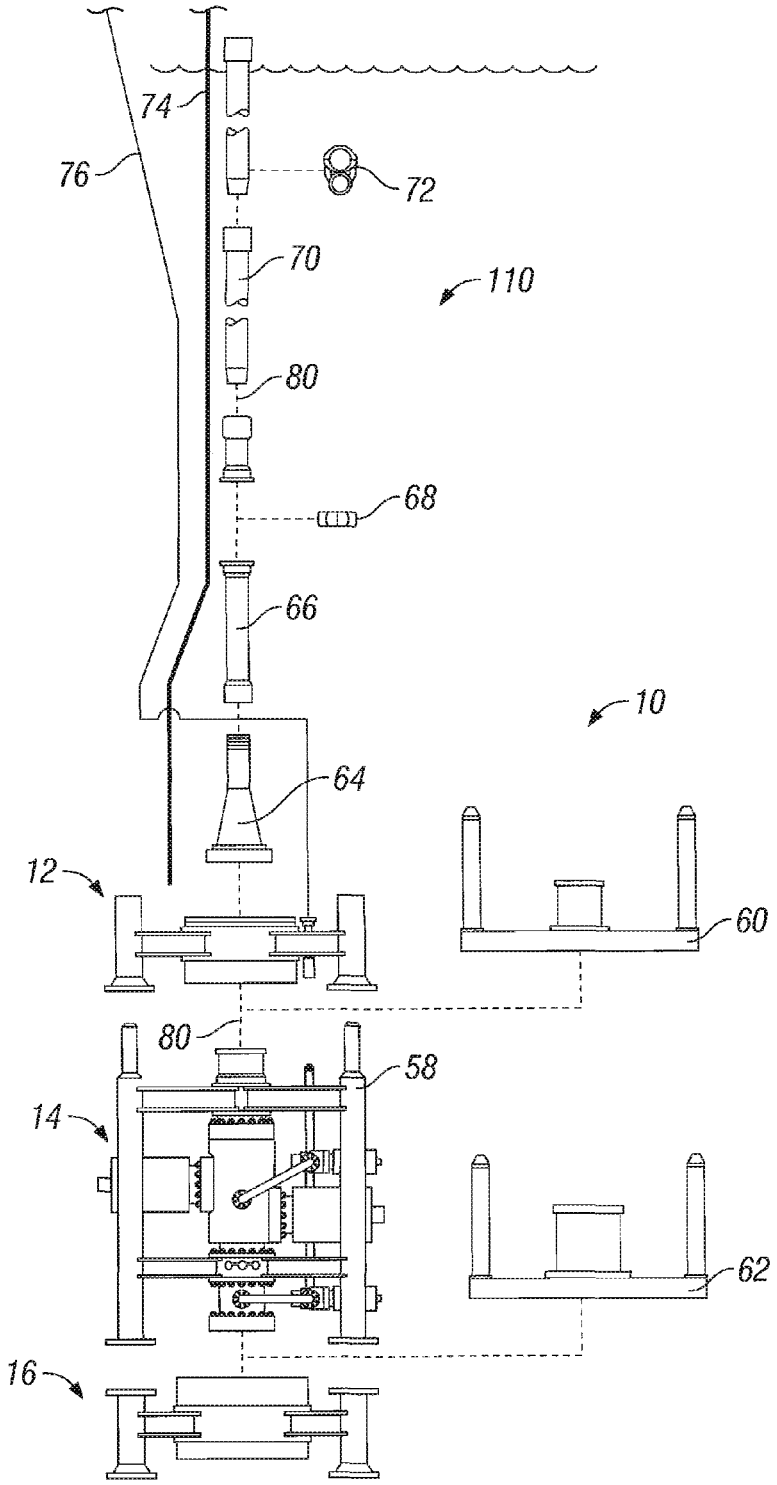
FIG. 2 is a schematic showing an assembly for use of the subsea intervention package with a riser system in accord with the present invention.
Figure 3A:
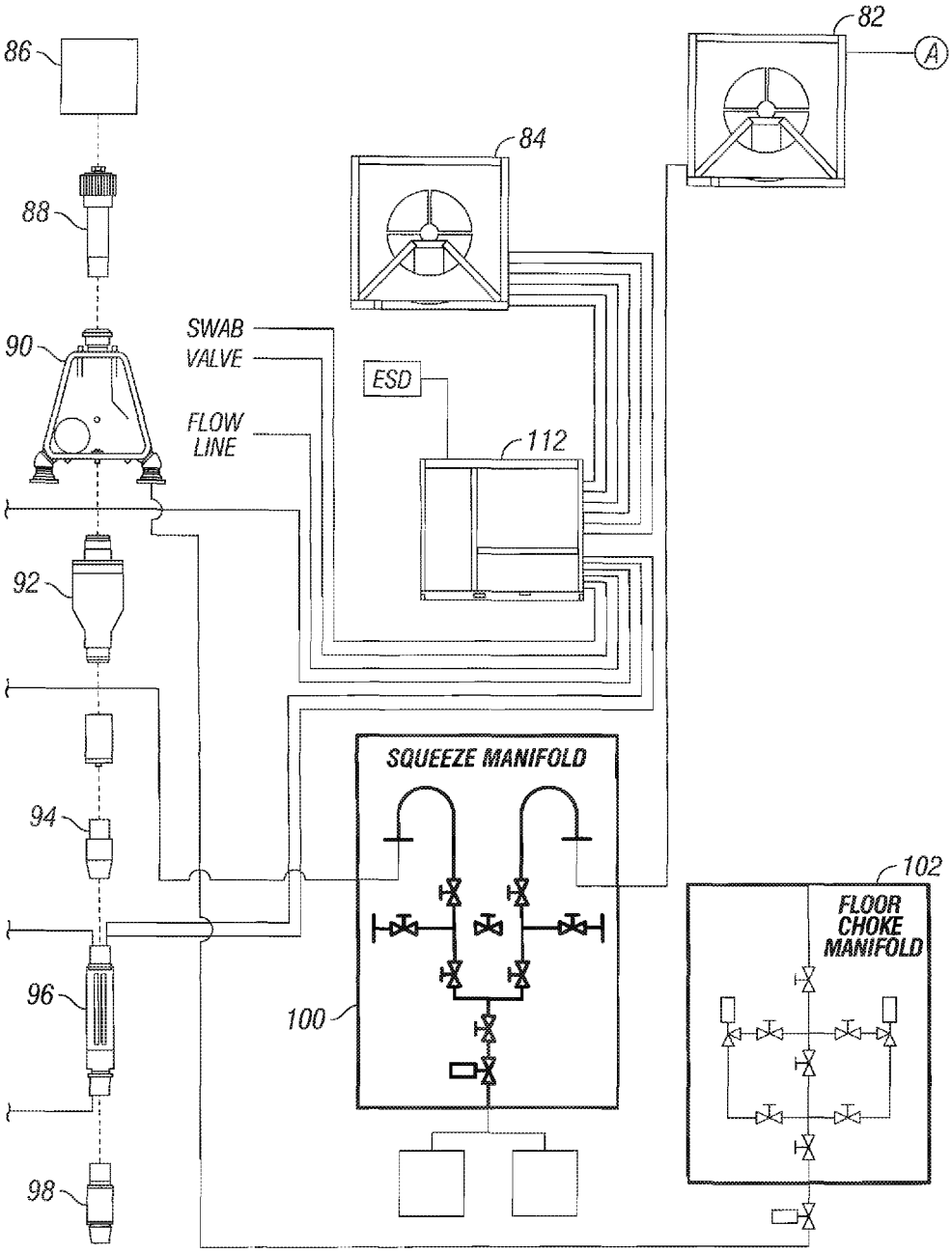
FIG. 3A is a schematic showing surface equipment for use with the intervention package and riser system in accord with the present invention.
Figure 3B:
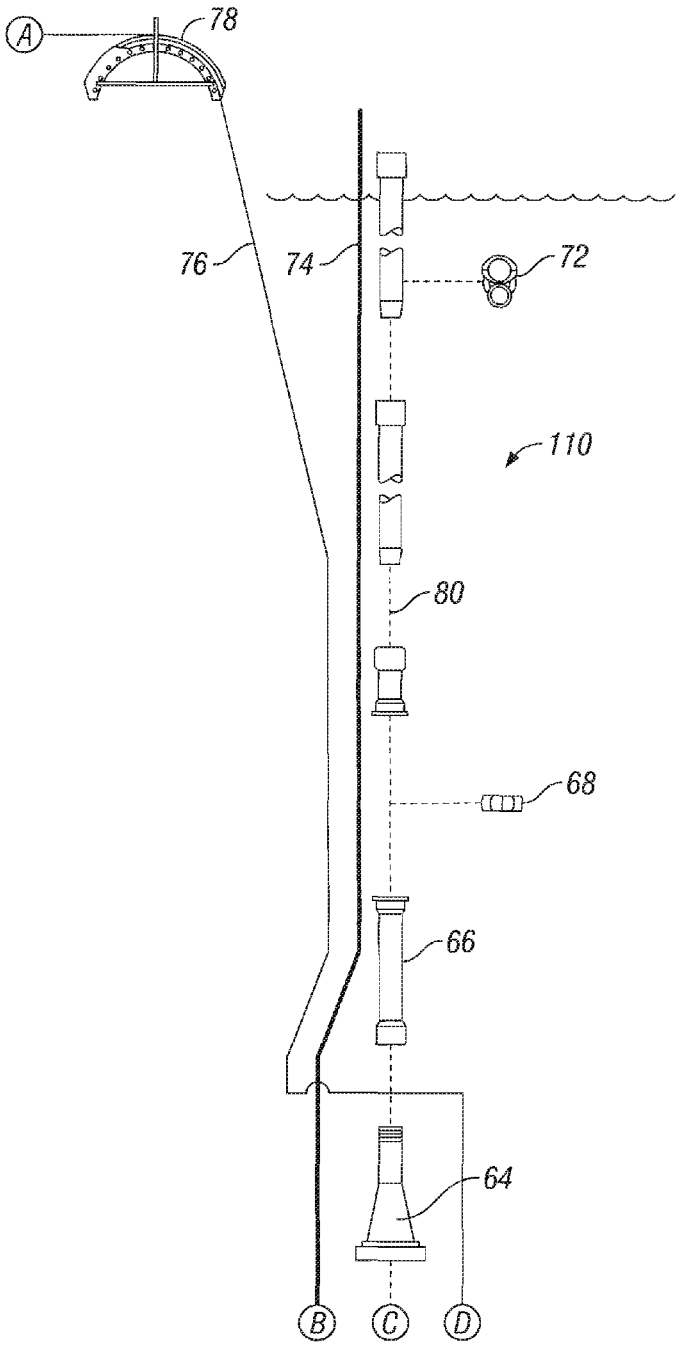
FIG. 3B is a schematic showing details of a riser system that may be used with the subsea intervention package in accord with the present invention.
Figure 3C:
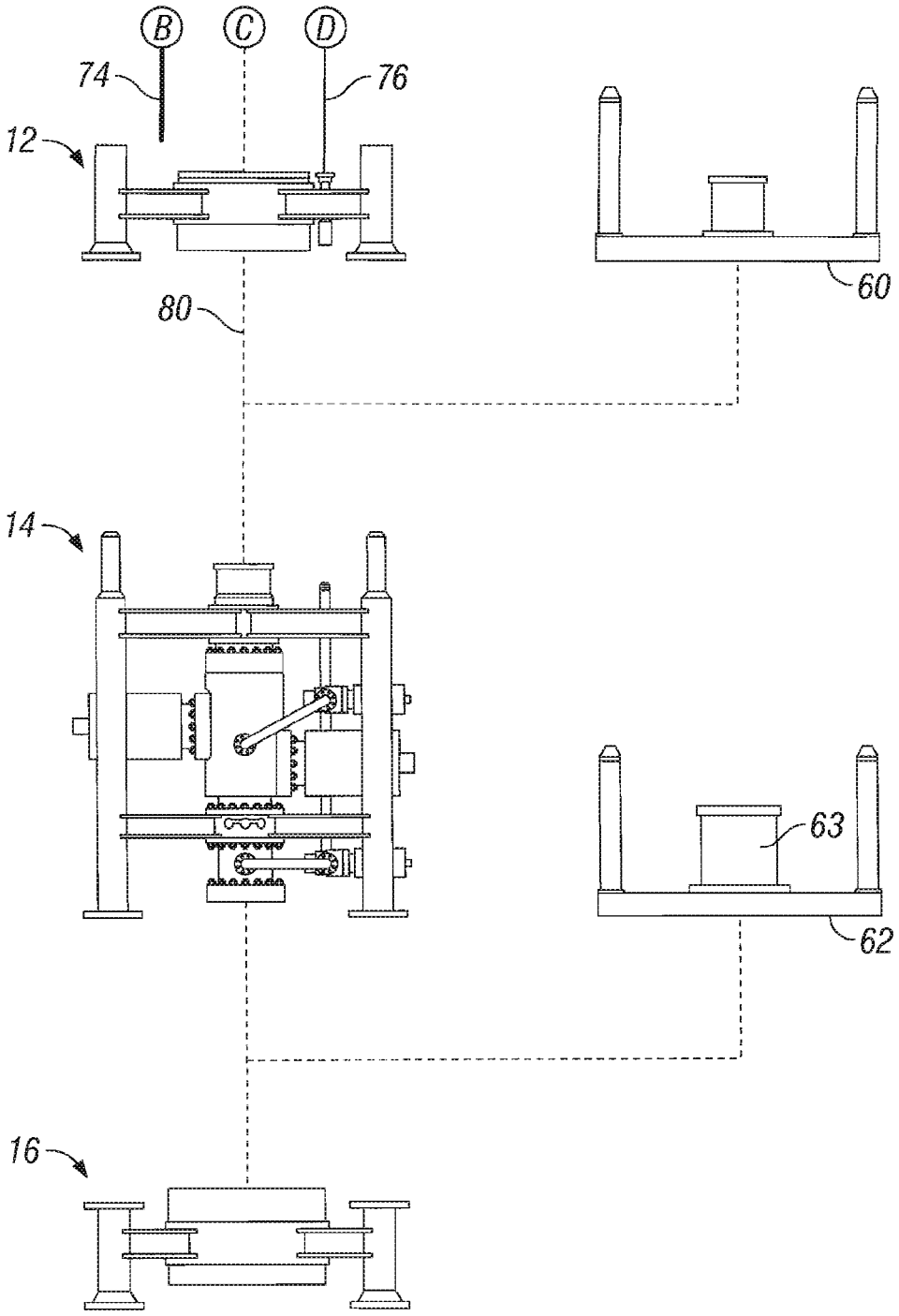
FIG. 3C is a schematic showing construction details for an intervention package in accord with one possible embodiment of the present invention.

FIG. 2 and in more detail, FIG. 3B and FIG. 3C, show subsea intervention package 10, or a representative view thereof, for use in the riser mode of operation wherein frame 58 of lower riser package 14 is connected to an emergency disconnect package as shown in more detail in FIG. 1 and FIG. 1B. If it is desired to operate in a wireline mode for instance, a lubricator with wireline BOP's and/or wireline gate valves may be utilized in place of emergency disconnect package 12. A lubricator is very similar to a riser in that it is pressure-controlled, but is very much shorter because it only needs to cover a downhole tool, e.g., a perforating gun or setting tool, for use in the subsea intervention. The ROA can be utilized in conjunction with a lubricator, e.g., to stab the downhole tool into the lubricator.

As shown in FIG. 2-FIG. 3C, riser system 110 preferably comprises a plurality of elements which may be sealed at the surface utilizing flowhead 90 and swivel 92 (see FIG. 3A). In a most preferred embodiment, the riser system comprises a flowhead with internal swivel as discussed in more detail in the aforementioned patents and patent applications whereby the riser system is more easily deployed and lifted. Cross-over 94 may be utilized to mate the flowhead with internal swivel to various different size riser systems.

Referring to FIG. 2, stress joint 64 and stress joint saver sub 66 of riser system 110 is utilized to absorb most of the bending forces that exist at lower side of riser system 110, e.g., due to ocean currents, waves, movement of a dynamically positioned vessel, and the like. Various other general elements of riser system 110, as shown in FIG. 2 and FIG. 3B, may include riser clamp 68, multiple riser tubulars 70 and umbilical clamp assembly 72. Other various elements may be used for supporting riser system 110 such as a riser spider (not shown), lubricator valve cross-over 98, lubricator valve 96, swivel assembly 92/flow head assembly 90 which may be integral to each other, handling/test sub 88 and handling frame 86. As shown in the present embodiment, riser system 110 may be utilized for various purposes including performing testing of the well to thereby predict the value or the well including flow rates, expected life, and other variables. Riser system 110 may be utilized for a wide variety of different intervention purposes such as setting plugs, perforating, cementing, and the like. Control members such as an emergency shutdown system 112, squeeze manifold 100 and/or floor choke manifold 102 may be utilized in the testing process.

Various control lines are preferably utilized in conjunction with riser system 110 such as umbilical cord 74 and annulus line 76. Various sheaves, pulleys, or the like such as reel 78 may be utilized to direct cables from the vessel into the subsea environment. Annulus cable reel 78 and umbilical cable reel 84 may be utilized to supply and take up these control cables. Umbilical cable reel 82 and annulus cable reel 84 may be controlled by emergency shutdown system 112. Under emergency conditions, the cable reels may be programmed to automatically wind upwardly during shutdown situations. If wireline and/or coiled tubing are utilized, then those reels may also be tied into emergency shutdown system 112 to begin spooling upwardly and applying tension under emergency conditions to thereby aid in cutting and sealing of the wellbore utilizing the gate valves discussed hereinbefore which are also preferably controlled by emergency shutdown system 112. It may be preferable to have the wireline and/or tubing in tension prior to cutting to thereby obtain the best cut and also so the tension pulls the cut end up into the riser out of the way to thereby permit more quickly sealing the bottom of the riser. FIG. 3C shows in exploded form generalized features of subsea intervention package 10 including features of emergency connections to wellbore 80, annulus 76 and umbilical cord 74 with respect to disconnect package 12. As further shown in FIG. 3C, generalized test frames 60 and 62 or similar test frame construction may be utilized in conjunction with transportation, testing, and/or handling of the frames of lower riser package 14, emergency disconnect package 12, and/or adaptor frame or customer interface connection 16. Spools such as spool 63 may be provided for various purposes as desired. Annulus line 76 and/or umbilical cord 44 provide control lines, pressure lines, and the like which may be very useful in operating, controlling, and/or repairing the subsea well and/or operating subsea intervention package 10 and/or operating other equipment.

Figure 4A:
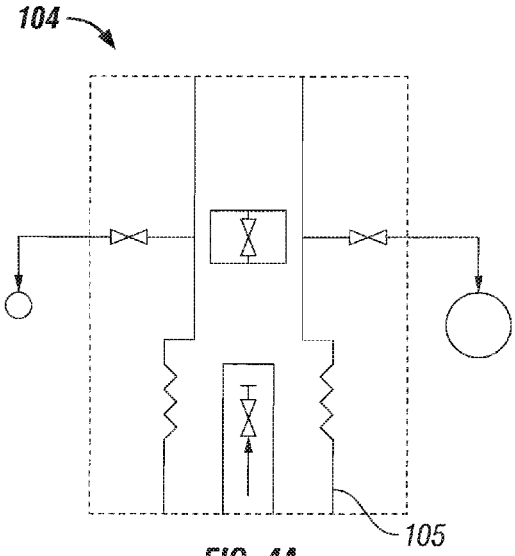
FIG. 4A (Prior Art)
FIG. 4A is a schematic showing generally a horizontal Christmas tree for a subsea well which may serviced in accord with the present invention.
Figure 4B:
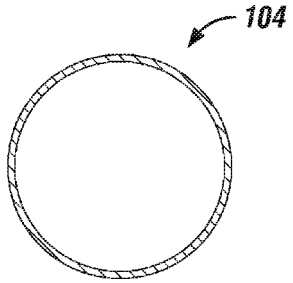
FIG. 4B (Prior Art)
FIG. 4B is a schematic showing the bore of the horizontal Christmas tree of FIG. 4A.
Figure 5A:
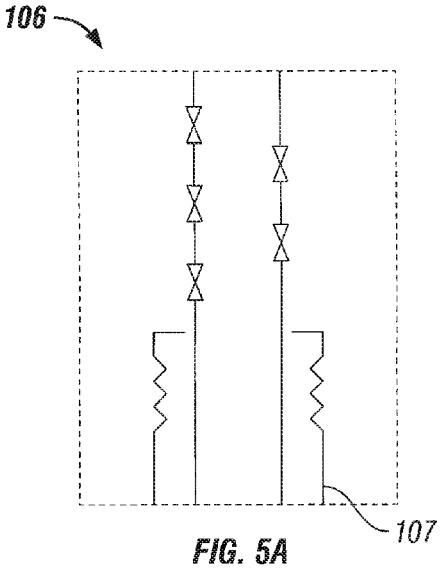
FIG. 5A (Prior Art)
FIG. 5A is a schematic showing generally a vertical Christmas tree for a subsea well which may be serviced in accord with the present invention.
Figure 5B:
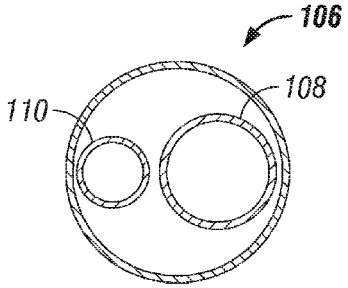
FIG. 5B (Prior Art)
FIG. 5B is a schematic showing the bore of the horizontal Christmas tree of FIG. 5A.

The present invention is operable with both vertical production trees and horizontal production trees. Horizontal production tree 104 is shown schematically in FIG. 4A wherein spool 105 is configured such that entire bore is available for tools or equipment to service the well as indicated in FIG. 4B. Vertical production tree 106 is shown schematically in FIG. 6A wherein spool 107 is configured such that smaller different bores such as bores 108 and 110 must be utilized to service the well as indicated in FIG. 5B. The prior art subsea intervention packages are often not able to retrieve the typically larger tree plugs used in horizontal production trees because of the need for a larger size bore therethrough while limitations exist as to total space and preferred reduced cost.

In operation, the small profile and lightweight subsea intervention package 10 of the present invention are relatively easily transported, launched, utilized, and retrieved thereby saving very significant costs and permitting subsea wells to operate more effectively. If hydraulic power is lost, then fail safe actuators in lower riser package 14 and emergency disconnect package 12 (assuming riser operation mode) will close and seal. If any coiled tubing, production tubing, and/or cable such as braided cable or slick line are in the valves, such as may occur during a wireline operation, then these members will be severed. Although it is believed the modules are very reliable for cutting and sealing, the manual override actuators can also be utilized by the ROVs (remotely operated vehicles) to complete the closing or cutting or as a backup procedure or other option. The closing of emergency disconnect package 12 quickly seals the bottom of the rise to prevent any leakage of material therefrom thereby greatly enhancing environmental protection as compared to prior art systems. For instance, if the riser is 1000 feet and filled with fluids, then these fluids can be prevented from leaking.

In an emergency, emergency shut down control system 112 sends a signal to close the gate valves as discussed above. As well, the reels for any coiled tubing and/or wireline may also be activated to pull tension thereon so if cut they will immediately move into the riser before the riser is sealed off. If desired, the gate valve on emergency disconnect package 12 may be timed to delay operating for a few seconds to permit the coiled tubing/wireline to pull in the riser before closing.

If desired, then emergency disconnect package 12 may be removed and replaced with a subsea lubricator package and the like whereby a ROV can stab wireline and/or coiled tubing into the lubricator and seal the top of the lubricator with stuffing box, grease head or the like. A lubricator is generally a pressurized/sealable containment pipe such as a riser, but is typically much shorter in that it simply covers a wireline tool or the like, e.g. a perforating gun or packer setting tool. Wireline BOP's may be utilized or wireline gate valve cutters could be utilized on the lubricator.

In general, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. One of skill in the art upon reviewing this specification will understand that the relative size and shape of the components may be greatly different from that shown and the invention can still operate in accord with the novel principals taught herein. For subsea valves, it will also be understood that depending on the water depth, suitable modifications may be made to offset water depth pressure. Moreover, different seals and/or relief valves and so forth may be used in the valve system such as in the valve bonnet, manual override housing, actuator housing, and the like. Moreover, a housing for an actuator, valve, or the like may include various portions or components that may or may not comprise part of another housing used for another purpose and so a housing is simply construed as a container for certain components, for example an actuator housing is a container or body for actuator components, that may be constructed in many ways and may or may not also comprise a housing of a different type such as a valve housing.

Accordingly, the present invention provides a method for a gate valve mountable onto a wellbore casing/riser. The gate valve is preferably operable for controlling fluid and/or cutting tubing or wireline. The method may comprise one or more steps such as, for instance, mounting the gate valve on the subsea intervention package for controlling fluid flow preferably without also utilizing a BOP on the intervention package, mounting a slidable gate within the gate valve, providing the slidable gate may have a first side and a second side opposite the first side, providing first and second seats for the slidable gate such that the first side of the gate is preferably adjacent the first seat and the second side of the gate is preferably adjacent the second seat, providing a single cutting edge on the slidable gate of the gate valve such that the slidable gate defines an aperture through the slidable gate, positioning the single cutting edge such that the aperture has a minimum diameter at the cutting edge, forming the cutting edge adjacent the first side of the gate, and/or providing an inclined surface on the gate such that the inclined surface defines at least a portion of the aperture such that the aperture increases in diameter with respect to axial distance away from the cutting edge such that the aperture has a maximum diameter towards an opposite side of the gate.

Other steps may comprise mounting the gate valve in subsea intervention package 10. In one embodiment the method may further comprise providing that the first seat is preferably formed by telescoping interconnecting two seat elements with respect to each other, providing that the second seat is preferably formed by telescoping interconnecting two seat elements with respect to each other, and/or providing that the aperture has a minimum diameter at the first side of the slidable gate.

In another embodiment, a method is provided for determining force needed on a gate to cut a tubular/wireline disposed within a gate valve. The gate valve is preferably mountable on a subsea intervention package such that the tubular is preferably positional within the wellbore casing. The method may comprise one or more steps such as, for instance, providing a test body for slidably supporting a test gate, the test gate may comprise dimensions related to the gate, inserting a test pipe through the test body and the test gate, the test pipe may comprise dimension related to the tubular, applying force to the test gate until the pipe is cut by the test gate, and measuring the force on the test gate required for cutting the test pipe. The method may also comprise designing an actuator for the gate such that the actuator is capable of producing the force and/or utilizing a hydraulic press for applying the force to the test gate.

In another embodiment, a method is provided for cutting a pipe within a wellbore utilizing a gate valve such that the pipe is pushed away from a gate within the gate valve. The method may comprise one or more steps such as, for instance, providing the gate valve with a single cutting edge on one side of the gate along the aperture through the gate, providing an inclined surface on the aperture through the gate such that the aperture opens to a maximum diameter distal the single cutting edge, inserting the pipe into the wellbore through the gate valve, closing the gate within the gate valve, and cutting the pipe as the gate closes such that the inclined surface produces a force on the pipe to move the pipe away from the gate.

Therefore an apparatus is provided comprising a gate valve for an subsea intervention package which may have no B.O.P. whatsoever to save space and weight. The apparatus comprises one or more elements such as, for instance, a sliding gate within the gate valve, a single cutting edge mounted on one side of the sliding gate, an inclined surface adjacent the cutting edge such that the single cutting edge and the inclined surface define an aperture through the sliding gate, and a hydraulic actuator for the gate valve operable to apply sufficient force to the sliding gate to cut the tubular. In one embodiment, the inclined surface is angled with respect to an axis through the aperture and flow path of the gate valve by from three degrees to twenty degrees. While the present invention is described in terms of a subsea valve system especially suitable for a lower riser package, the valve system of the present invention may be utilized in surface valve systems, pipelines, and any other applications, if desired.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention. Moreover, the scope of this patent is not limited to its literal terms but instead embraces all equivalents to the claims described.

What is claimed is:

1. A lightweight subsea intervention package for use in servicing a subsea well, said lightweight subsea intervention package being operable for containing tubing, coiled tubing, and wireline during said servicing of said subsea well, said lightweight subsea intervention package comprising:

a lower package connectable to said subsea well, said lower package comprising at least two gate valves;

a hydraulic actuator attached to each of said at least two gate valves;

at least one of said at least two gate valves being operable for cutting said tubing, coiled tubing, and wireline;

said lower package defining a bore through said at least two gate valves;

a disconnect mechanism comprising a first portion and a second portion, said first portion of said disconnect mechanism being secured to said lower package, said first portion and said second portion being selectively separable; and an emergency disconnect package mounted adjacent to said second portion of said disconnect mechanism, said emergency disconnect package comprising at least one emergency disconnect valve, said emergency disconnect package defining a bore through said at least one emergency disconnect valve.

2. The lightweight subsea intervention package of claim 1, wherein said at least one emergency disconnect valve comprises a hydraulically operated valve.

3. The lightweight subsea intervention package of claim 1, wherein said at least one emergency disconnect valve comprises a failsafe valve.

4. The lightweight subsea intervention package of claim 1, wherein said at least one emergency disconnect valve is operable for cutting said tubing, coiled tubing, and wireline, said bore through said at least two gate valves being greater than six and one-eighth inches, and said bore through said at least one emergency disconnect valve being greater than six and one-eighth inches.

5. The lightweight subsea intervention package of claim 1, further comprising a separately operable mechanism for each of said at least two gate valves that operates separately with respect to each said hydraulic actuator attached to each of said at least two gate valves, said separately operable mechanism being selectively operable t to control movement of each of said at least two gate valves.

6. The lightweight subsea intervention package of claim 5, wherein said separately operable mechanism comprises a manual override operator.

7. The lightweight subsea intervention package of claim 1, wherein at least one of said hydraulic actuator attached to each of said at least two gate valves comprises a failsafe actuator.

8. The lightweight subsea intervention package of claim 1, wherein said bore through said at least two gate valves is sufficiently large for use with a vertical Christmas tree or a horizontal Christmas tree.

9. A method for making a lightweight subsea intervention package for use in servicing a subsea well, said lightweight subsea intervention package being operable for containing tubing, coiled tubing, and wireline during said servicing of said subsea well, said method comprising:

configuring a lower package to be connectable to said subsea well;

providing that said lower package comprises at least two gate valves;

attaching a respective hydraulic actuator to each of said at least two gate valves;

providing that at least one of said at least two gate valves are configured for cutting said tubing, coiled tubing, and wireline;

providing that said lower package defines a bore through said at least two gate valves;

providing a disconnect mechanism with a first portion that is selectively separable from a second portion;

securing said first portion of said disconnect mechanism to said lower package;

mounting an emergency disconnect package adjacent to said second portion of said disconnect mechanism;

providing that said emergency disconnect package comprises at least one emergency disconnect valve; and providing that said emergency disconnect package defines a bore through said at least one emergency disconnect valve.

10. The method of claim 9, further comprising attaching a separately operable mechanism for each of said at least two gate valves, said separately operable mechanism being selectively operable to control movement of each of said at least two gate valves that operates separately with respect to each said respective hydraulic actuator attached to each of said at least two gate valves, and providing that said bore through said at least two gate valves is greater than six and one-eighth inches and that said bore through said at least one emergency disconnect valve being greater than six and one-eighth inches.

11. The method of claim 10, further comprising providing that said separately operable mechanism comprises a manual override operator.

12. The method of claim 9, further comprising providing that at least one said respective hydraulic actuator comprises a failsafe actuator.

13. The method of claim 9, further comprising providing that said at least one emergency disconnect valve comprises a hydraulically operated valve.

14. The method of claim 9, further comprising providing that said at least one emergency disconnect valve comprises a failsafe valve.

15. The method of claim 9, further comprising providing that said at least one emergency disconnect valve is operable for cutting said tubing, coiled tubing, or wireline.

16. A lightweight subsea intervention package for use in servicing a subsea well, said lightweight subsea intervention package being operable for containing tubing, coiled tubing, and wireline during said servicing of said subsea well, said lightweight subsea intervention package comprising:

a lower package connectable to said subsea well, said lower package comprising at least two gate valves;

said at least two gate valves each comprising a gate which moves in a linear direction transverse to a wellbore to control fluid flow through said wellbore;

a hydraulic actuator attached to each of said at least two gate valves and connected to respective of said gates to control movement of said gates, said hydraulic actuator extending radially outwardly with respect to said wellbore;

at least one hydraulic actuator comprising a failsafe actuator, said failsafe actuator extending radially outwardly with respect to said wellbore;

at least one of said at least two gate valves being operable for cutting said tubing, coiled tubing, and wireline, said lower package defining a bore through said at least two gate valves; and a separately operable mechanism for each of said at least two gate valves that is selectively operable to operate each of said at least two gate valves separately from said hydraulic actuator.

17. The lightweight subsea intervention package of claim 16, wherein said separately operable mechanism comprises a manual override operator.

18. The lightweight subsea intervention package of claim 16, wherein at least one of said hydraulic actuators comprises a failsafe actuator, said bore through said at least two gate valves is greater than six and one-eighth inches.

19. The lightweight subsea intervention package of claim 16, wherein said lightweight subsea intervention package is operable for use with a vertical Christmas tree or a horizontal Christmas tree.

20. The lightweight subsea intervention package of claim 16, further comprising:

a disconnect mechanism comprising a first portion and a second portion, said first portion of said disconnect mechanism being secured to said lower package, said first portion and said second portion being selectively separable; and an emergency disconnect package mounted adjacent to said second portion of said disconnect mechanism, said emergency disconnect package comprising at least one emergency disconnect valve, said emergency disconnect package defining a bore through said at least one emergency disconnect valve which is greater than six and one-eighth inches.

21. The lightweight subsea intervention package of claim 20, wherein said at least one emergency disconnect valve comprises a hydraulically operated valve.

22. The lightweight subsea intervention package of claim 20, wherein said at least one emergency disconnect valve comprises a failsafe valve.

23. A lightweight subsea intervention package for use in servicing a subsea well, said lightweight subsea intervention package being operable for containing tubing, coiled tubing, and wireline during said servicing of said subsea well, said lightweight subsea intervention package comprising:

a lower package connectable to said subsea well, said lower package comprising at least two gate valves;

a hydraulic actuator attached to each of said at least two gate valves;

at least one separately operable mechanism for at least one of said at least two gate valves, said at least one separately operable mechanism being selectively operable to control movement of said at least one of said at least two gate valves, said at least one separately operable mechanism operates separately with respect to each said hydraulic actuator attached to each of said at least two gate valves;

at least one of said at least two gate valves being operable for cutting said tubing, coiled tubing, and wireline; and said at least two gate valves defining a bore therethrough.

24. The lightweight subsea intervention package of claim 23, wherein said at least one separately operable mechanism comprises a manual override operator.

25. The lightweight subsea intervention package of claim 23, wherein at least one of said hydraulic actuators comprises a failsafe actuator and said bore through said at least two gate valves being greater than six and one-eighth inches.

26. The lightweight subsea intervention package of claim 23, further comprising:

a disconnect mechanism comprising a first portion and a second portion, said first portion of said disconnect mechanism being secured to said lower package, said first portion and said second portion being selectively separable; and an emergency disconnect package mounted adjacent to said second portion of said disconnect mechanism, said emergency disconnect package comprising at least one emergency disconnect valve, said emergency disconnect package defining a bore through said at least one emergency disconnect valve.

27. The lightweight subsea intervention package of claim 26, wherein said at least one emergency disconnect valve comprises a hydraulically operated valve and said bore through said at least one emergency disconnect valve which is greater than six and one-eighth inches.

28. The lightweight subsea intervention package of claim 26, wherein said at least one emergency disconnect valve comprises a failsafe valve.

29. The lightweight subsea intervention package of claim 26, wherein said at least one emergency disconnect valve is operable for cutting said tubing, coiled tubing, or wireline.

* * * * *